US006032880A

United States Patent [19]

Verrills et al.

[11] Patent Number: 6,032,880

[45] Date of Patent: Mar. 7, 2000

[54] GROUND SPIKE FOR A SUN UMBRELLA

[76] Inventors: Robert H. Verrills; Daphne Verrills, both of 71 Wordsworth Drive, Cheam, Surrey, United Kingdom, SM3 8HE

[21] Appl. No.: 09/090,325

[22] Filed: Jun. 4, 1998

[51] Int. Cl.[7] ..... F16M 13/00

[52] U.S. Cl. ..... 240/530; 248/545; 248/156; 52/155; 52/157; 52/736.2; 52/736.3

[58] Field of Search ..... 248/545, 530, 248/156; 52/736.2, 736.3, 155, 157, 165

[56] References Cited

U.S. PATENT DOCUMENTS

| | | | |
|---|---|---|---|
| 962,632 | 6/1910 | Frost | 52/165 |
| 1,731,645 | 9/1929 | Williams | 52/155 |
| 2,441,109 | 11/1948 | Carlson | 248/156 |
| 4,850,565 | 7/1989 | Moreno | 248/545 |
| 5,088,681 | 2/1992 | Procaccianti et al. | 248/530 |
| 5,349,775 | 9/1994 | Mondares | 43/21.2 |
| 5,358,209 | 10/1994 | Ward | 248/545 |
| 5,457,918 | 10/1995 | Plourde | 52/165 |
| 5,662,304 | 9/1997 | McDaniel | 248/499 |
| 5,809,700 | 9/1998 | Roush et al. | 52/4 |

*Primary Examiner*—Leslie A. Braun
*Assistant Examiner*—Walter Landry

[57] ABSTRACT

A beach umbrella support is provided including a rigid hollow post. Also included is a spiral flange fixedly coupled to an outer surface of the post. At least one ear is fixedly coupled to the post and further fixed with respect to the flange for affording leverage. An umbrella rod is removably mounted within a top end of the post for being supported by the post.

5 Claims, 3 Drawing Sheets

GROUND SPIKE FOR A SUN UMBRELLA

BACKGROUND OF THE INVENTION

1. Field of the Invention

The present invention relates to umbrella supports and more particularly pertains to a new ground spike for a sun umbrella for supporting a beach umbrella or the like in sand.

2. Description of the Prior Art

The use of umbrella supports is known in the prior art. More specifically, umbrella supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art umbrella supports include U.S. Pat. Des. No. 359,437; U.S. Pat. No. 2,103,948; U.S. Pat. No. 5,396,916; U.S. Pat. No. 5,358,209; U.S. Pat. No. 3,044,478; and U.S. Pat. No. 5,088,681.

In these respects, the ground spike for a sun umbrella according to the present invention substantially departs from the conventional concepts and designs of the prior art, and in so doing provides an apparatus primarily developed for the purpose of supporting a beach umbrella in sand.

SUMMARY OF THE INVENTION

In view of the foregoing disadvantages inherent in the known types of umbrella supports now present in the prior art, the present invention provides a new ground spike for a sun umbrella construction wherein the same can be utilized for supporting a beach umbrella in sand.

The general purpose of the present invention, which will be described subsequently in greater detail, is to provide a new ground spike for a sun umbrella apparatus and method which has many of the advantages of the umbrella supports mentioned heretofore and many novel features that result in a new ground spike for a sun umbrella which is not anticipated, rendered obvious, suggested, or even implied by any of the prior art umbrella supports, either alone or in any combination thereof.

To attain this, the present invention generally comprises a rigid hollow post with a cylindrical configuration. The post includes an open top end and a closed bottom end with a conical configuration. Next provided is a spiral flange integrally coupled to an outer surface of the post. As shown in the Figures, the spiral flange extends from the bottom end to a central extent of the post. As such, a cork screw is defined. It should be noted that the flange extends radially a distance which decreases adjacent to the bottom end of the post. Such distance at the central extent of the post is preferably is ½ a diameter of the post. As shown in FIGS. 4 & 5, a pair of diametrically opposed ears are provided each defining a section of a planar disk. As such, each car is equipped with a pair of planar faces and a periphery defined by an arcuate extent and a linear extent. The linear extent of each ear is integrally coupled to the outer surface of the post adjacent to the top end thereof. As such, the ears reside in a common plane which includes an axis of the post for affording leverage when screwing the post within a recipient ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ground spike for a sun umbrella apparatus and method which has many of the advantages of the umbrella supports mentioned heretofore and many novel features that result in a new ground spike for a sun umbrella which is not anticipated, rendered obvious, suggested, or even implied by any of the prior art umbrella supports, either alone or in any combination thereof.

It is another object of the present invention to provide a new ground spike for a sun umbrella which may be easily and efficiently manufactured and marketed.

It is a further object of the present invention to provide a new ground spike for a sun umbrella which is of a durable and reliable construction.

An even further object of the present invention is to provide a new ground spike for a sun umbrella which is susceptible of a low cost of manufacture with regard to both materials and labor, and which accordingly is then susceptible of low prices of sale to the consuming public, thereby making such ground spike for a sun umbrella economically available to the buying public.

Still yet another object of the present invention is to provide a new ground spike for a sun umbrella which provides in the apparatuses and methods of the prior art some of the advantages thereof, while simultaneously overcoming some of the disadvantages normally associated therewith.

Still another object of the present invention is to provide a new ground spike for a sun umbrella for supporting a beach umbrella in sand.

Even still another object of the present invention is to provide a new ground spike for a sun umbrella that includes a rigid hollow post. Also included is a spiral flange fixedly coupled to an outer surface of the post. At least one ear is fixedly coupled to the post and further fixed with respect to the flange for affording leverage. An umbrella rod is removably mounted within a top end of the post for being supported by the post.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description make reference to the annexed drawings wherein.

DESCRIPTION OF THE PREFERRED EMBODIMENT

Figure 1:
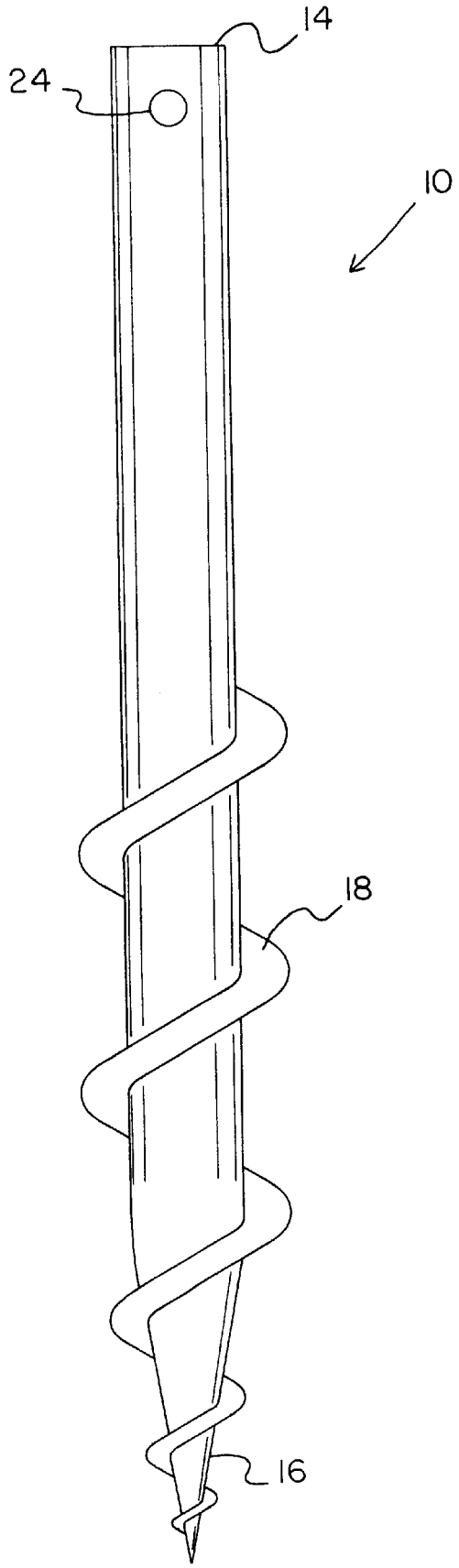
FIG. 1 is a side view of a first embodiment of the present invention.

With reference now to the drawings, and in particular to FIGS. 1 through 5 thereof, a new ground spike for a sun umbrella embodying the principles and concepts of the present invention and generally designated by the reference numeral 10 will be described.

The present invention, designated as numeral 10, includes a plastic or metal hollow post 12 with a cylindrical configuration. Ideally, the post has a length of about 40 inches. The post includes an open top end 14 and a closed bottom 16 end with a conical configuration.

Next provided is a spiral flange 18 integrally coupled to an outer surface of the post and extending radially therefrom. As shown in the Figures, the spiral flange extends from the bottom end of the post to a central extent thereof. As such, a cork screw is defined. It should be noted that the flange extends radially a distance which decreases adjacent to the bottom end of the post. As shown in the Figures, an upper ⅔ a extent of flange has a common diameter and is mounted on a cylindrical portion of the post. A lower ⅓ extent of the flange tapers inwardly along a conical portion of the post. Further, the distance which the flange radially extends at the central extent of the post is preferably ½ a diameter of the post.

Figure 4:
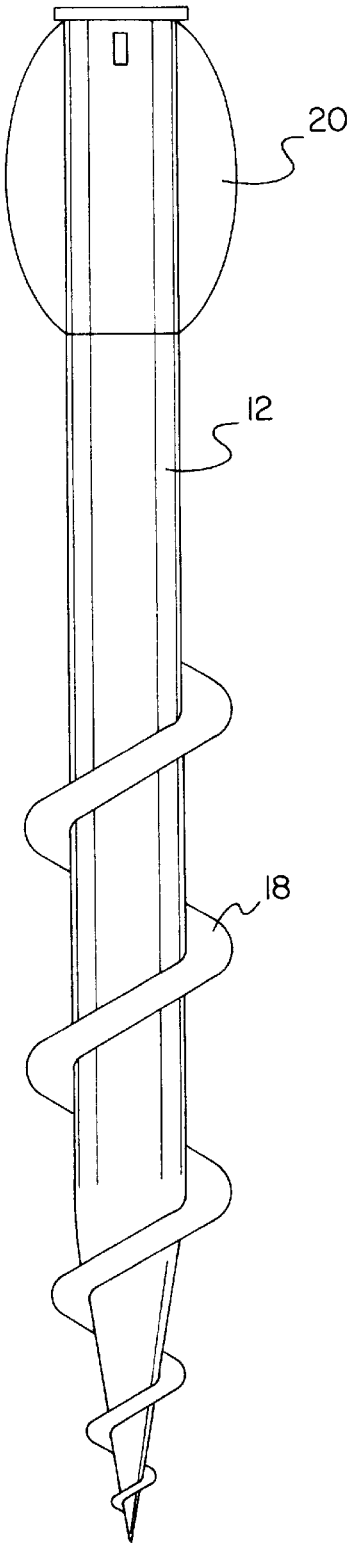
FIG. 4 is a side view of another embodiment of the present invention.
Figure 5:
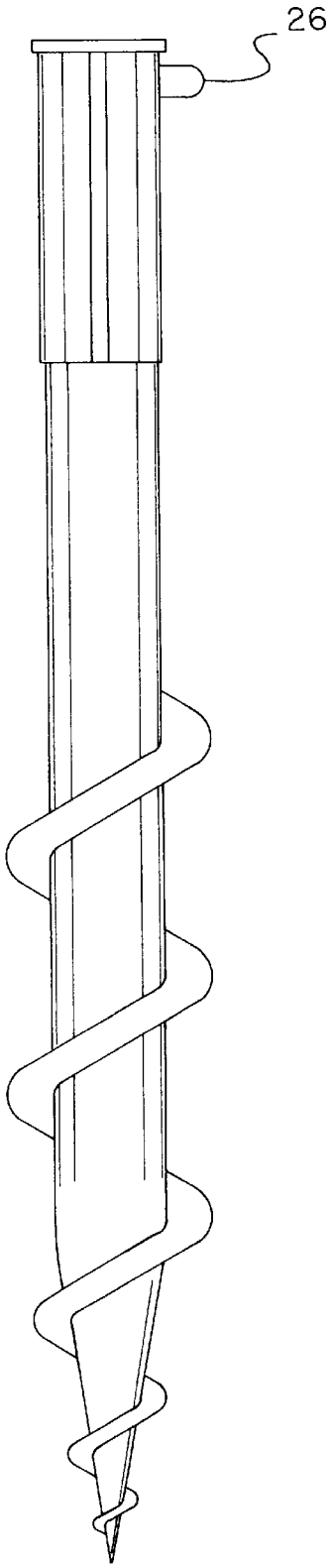
FIG. 5 is another side view of the embodiment of FIG. 4 which is rotated with respect to FIG. 4.

As shown in FIGS. 4 & 5, a pair of diametrically opposed ears 20 are provided each defining a section of a planar disk. As such, each ear is equipped with a pair of planar faces and a periphery defined by an arcuate extent and a linear extent. The linear extent of each ear is integrally coupled to the outer surface of the post adjacent to the top end thereof. As such, the ears reside in a common plane which includes an axis of the post for affording leverage when screwing the post within a recipient ground surface. In the preferred embodiment, an apex of each ear extends a distance from the post which is about equal to the diameter of the post. Further, each ear preferably extends along about ¼ a length of the post. In use, an umbrella rod is removably mounted within the top end of the post for being supported by the post.

Figure 2:
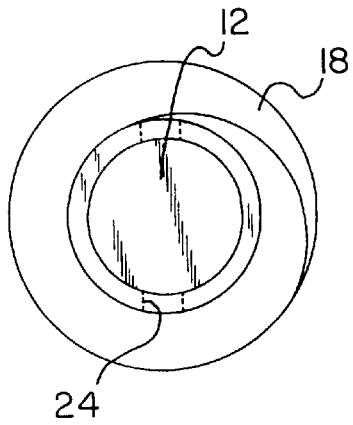
FIG. 2 is a top view of the present invention.
Figure 3:
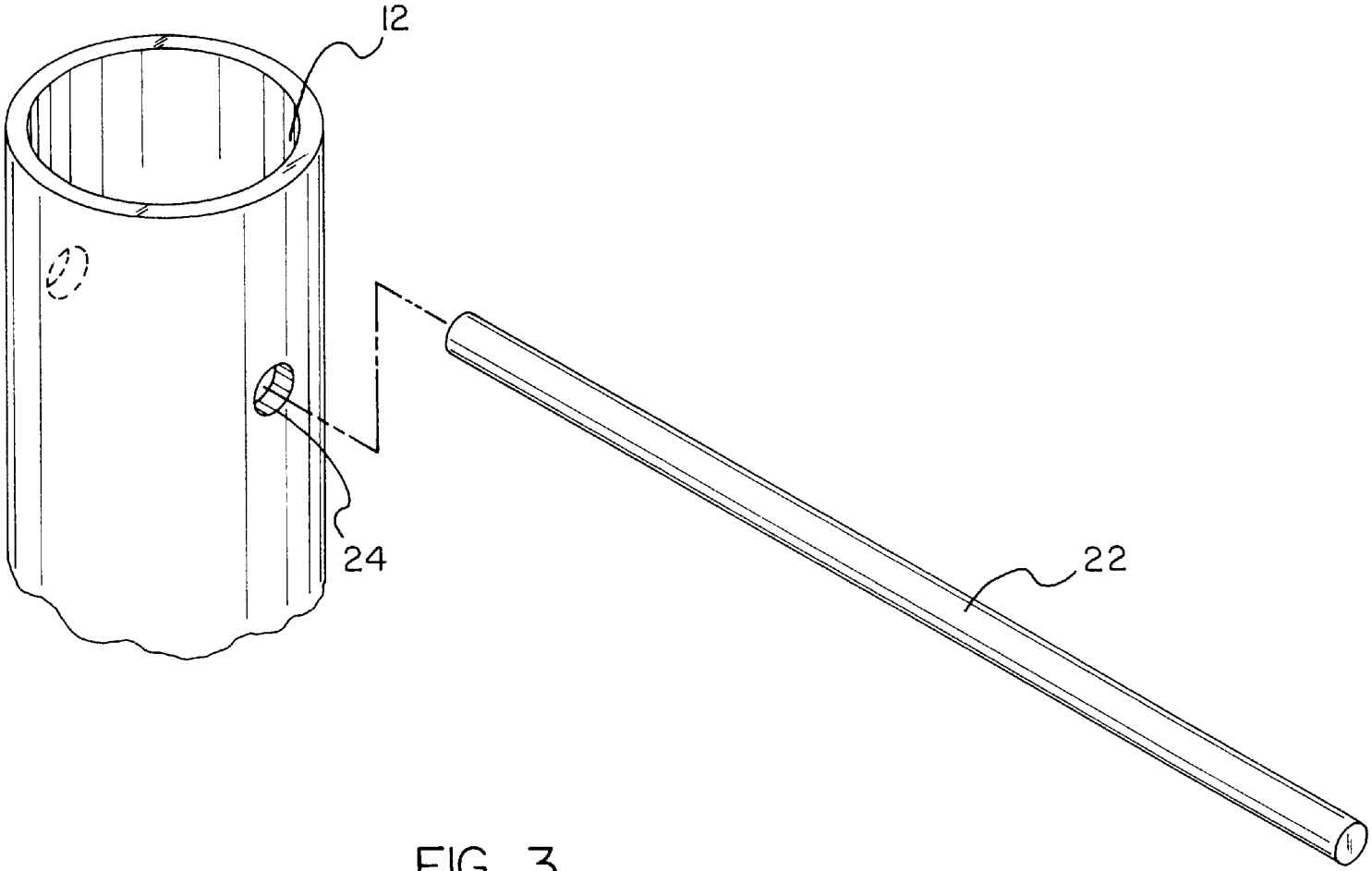
FIG. 3 is a perspective view of the embodiment of the present invention shown in FIGS. 1–2.

In another embodiment, as shown in FIGS. 1–3, the ear takes the form of a cylindrical rod 22. Such rod is slidably and removably inserted within a pair of diametrically opposed bores 24 formed in the post adjacent to the open top thereof.

As an option, a securement mechanism 26 may be situated on the post adjacent to the open top thereof. As shown in FIGS. 4 & 5, the securement mechanism is offset from each of the ears by 90 degrees. Further, the securement mechanism preferably includes a lever which is pivotally coupled to the post. Such lever has a first orientation for engaging the umbrella rod and a second orientation for disengaging the umbrella rod. To accomplish this, lever may include a rounded inboard portion extending through a cut out in the post and a gripping outboard portion.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended-to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A beach umbrella support comprising:

a rigid hollow post with a cylindrical configuration including an open top end and a closed bottom end, the closed bottom end having a conical configuration for penetrating a ground surface;

a spiral flange integrally coupled to an outer surface of the post and extending from the bottom end to a central extent of the post, wherein the flange extends radially outward a distance which decreases toward the bottom end of the post, wherein the distance at the central extent is approximately ½ a diameter of the post;

a pair of diametrically opposite ears each extending radially outward from the outer surface of the post, each of the opposed ears defining a section of a planar disk with a pair of planar faces and a periphery defined by an arcuate extent and a linear extent, the arcuate extent protruding outward from the outer surface a distance less than the diameter of the post for reducing the possibility of accidental impact with the ears and the arcuate extent having a smooth, rounded profile for reducing the possibility of injury from accidental impact with the ears, the linear extent of each ear being integrally coupled to the outer surface of the post adjacent to the top end thereof such that the cars reside in a common plane which includes an axis of the post for forming a handle affording leverage when screwing the post into a ground surface; and an umbrella rod removably mounted in the top end of the post for being supported by the post.

2. A beach umbrella support comprising:

a rigid hollow post with a generally cylindrical configuration including an open top end and a closed bottom end, the closed bottom end having a conical configuration for penetrating a ground surface;

a spiral flange fixedly coupled to an outer surface of the post; and a pair of diametrically opposite ears each extending radially outward from the outer surface of the post, each of the opposed ears defining a section of a planar disk with a pair of planar faces and a periphery defined by an arcuate extent and a linear extent, the arcuate extent protruding outward from the outer surface a distance less than a diameter of the post for reducing the possibility of accidental impact with the ears and the arcuate extent having a smooth, rounded profile for reducing the possibility of injury from accidental impact with the ears, the linear extent of each ear being integrally coupled to the outer surface of the post adjacent to the top end thereof such that the ears reside in a common plane which includes an axis of the post for forming a handle affording leverage when screwing the post into a ground surface.

3. A beach umbrella support as set forth in claim 2 wherein the spiral flange extends from a bottom end to a central extent of the post, thereby defining a cork screw configuration.

4. A beach umbrella support as set forth in claim 2 wherein the post has a length, and wherein the spiral flange is confined to a lower half of the length of the post.

5. A beach umbrella support as set forth in claim 2 wherein the post has a length, and wherein the conical configuration is confined to a lower quarter of the length of the post.

* * * * *